US011062551B2

(12) United States Patent
Batsiokis

(10) Patent No.: US 11,062,551 B2
(45) Date of Patent: Jul. 13, 2021

(54) METHOD OF GAMING, A GAMING SYSTEM AND A GAME CONTROLLER

(71) Applicant: ARISTOCRAT TECHNOLOGIES AUSTRALIA PTY LIMITED, North Ryde (AU)

(72) Inventor: Amy Batsiokis, Marsfield (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 2 days.

(21) Appl. No.: 16/210,768

(22) Filed: Dec. 5, 2018

(65) Prior Publication Data

US 2019/0114874 A1 Apr. 18, 2019

Related U.S. Application Data

(63) Continuation of application No. 15/232,384, filed on Aug. 9, 2016, now Pat. No. 10,186,105.

(30) Foreign Application Priority Data

Aug. 10, 2015 (AU) ..... 2015903197

(51) Int. Cl.
*G07F 17/34* (2006.01)
*G07F 17/32* (2006.01)

(52) U.S. Cl.
CPC ..... *G07F 17/3213* (2013.01); *G07F 17/326* (2013.01); *G07F 17/3209* (2013.01); *G07F 17/3211* (2013.01); *G07F 17/3225* (2013.01); *G07F 17/3241* (2013.01); *G07F 17/3246* (2013.01); *G07F 17/3251* (2013.01); *G07F 17/34* (2013.01)

(58) Field of Classification Search
CPC ..... G07F 17/3211; G07F 17/3213
See application file for complete search history.

(56) References Cited

U.S. PATENT DOCUMENTS

| | | | |
|---|---|---|---|
| 5,833,537 | A | 11/1998 | Barrie |
| 5,980,384 | A | 11/1999 | Barrie |
| 7,252,591 | B2 | 8/2007 | Van Asdale |
| 8,096,877 | B2 | 1/2012 | Hoffman |
| 8,167,704 | B2 | 5/2012 | Yoshizawa |
| 8,512,127 | B2 | 8/2013 | Jaffe et al. |
| 8,574,059 | B2 | 11/2013 | Rodgers et al. |
| 8,986,102 | B2 | 3/2015 | Vandafele |
| 9,123,209 | B2 | 9/2015 | Pacey et al. |

(Continued)

*Primary Examiner* — Steven J Hylinski
(74) *Attorney, Agent, or Firm* — Armstrong Teasdale LLP

(57) ABSTRACT

Systems and methods of electronic gaming are disclosed. In various embodiments, a gaming system may implement a method for electronic gaming, which may comprise receiving a credit wager to initiate play of a game, selecting a plurality symbols from a plurality of reel strips stored in the memory, displaying the selected plurality of symbols in a plurality of adjacent columns of symbol display positions, dividing the symbol display positions in each of the plurality of columns into a first subset of symbol display positions and a second subset of symbol display positions, determining whether an evaluation change condition has been met with respect to a column in the plurality of columns, a first game evaluation based upon the evaluation change condition, and performing a second game evaluation based upon the evaluation change condition.

20 Claims, 7 Drawing Sheets

(56) References Cited

U.S. PATENT DOCUMENTS

| | | | |
|---|---|---|---|
| 9,495,839 | B2 | 11/2016 | Aoki et al. |
| 9,520,022 | B2 | 12/2016 | Gobe et al. |
| 9,600,979 | B2 | 3/2017 | Hornik et al. |
| 10,388,104 | B2 * | 8/2019 | Marks ..... G07F 17/34 |
| 2003/0045345 | A1 | 3/2003 | Berman |
| 2004/0009803 | A1 | 1/2004 | Bennett et al. |
| 2008/0064487 | A1 | 3/2008 | Stevens et al. |
| 2008/0102928 | A1 | 5/2008 | Daley |
| 2008/0146319 | A1 | 6/2008 | Yoshizawa |
| 2009/0124338 | A1 | 5/2009 | Watkins et al. |
| 2009/0124347 | A1 | 5/2009 | Rodgers et al. |
| 2009/0191950 | A1 | 7/2009 | Shai-Hee |
| 2009/0197667 | A1 | 8/2009 | Kim |
| 2010/0016061 | A1 | 1/2010 | Gomez et al. |
| 2010/0216540 | A1 | 8/2010 | Berman et al. |
| 2010/0234092 | A1 | 9/2010 | Gomez et al. |
| 2011/0098098 | A1 | 4/2011 | Stewart et al. |
| 2011/0151961 | A1 | 6/2011 | Stevens et al. |
| 2012/0083327 | A1 | 4/2012 | Zobel et al. |
| 2013/0072286 | A1 | 3/2013 | Suda |
| 2013/0184050 | A1 | 7/2013 | Zoble et al. |
| 2013/0260863 | A1 | 10/2013 | Lee et al. |
| 2014/0057698 | A1 | 2/2014 | Rodgers et al. |
| 2014/0066174 | A1 | 3/2014 | Rodgers et al. |
| 2014/0087822 | A1 | 3/2014 | Watkins |
| 2014/0162749 | A1 | 6/2014 | Ryan |
| 2014/0274294 | A1 | 9/2014 | Baelocher et al. |
| 2014/0342799 | A1 | 11/2014 | Deitz et al. |
| 2015/0170462 | A1 | 6/2015 | Berman et al. |
| 2016/0093147 | A1 | 3/2016 | Penacho et al. |
| 2016/0133094 | A1 | 5/2016 | Thomas et al. |

* cited by examiner

METHOD OF GAMING, A GAMING SYSTEM AND A GAME CONTROLLER

CROSS-REFERENCE TO RELATED APPLICATIONS

This application is a continuation application of U.S. patent application Ser. No. 15/232,384 filed Aug. 9, 2016, entitled "METHOD OF GAMING, A GAMING SYSTEM AND A GAME CONTROLLER", which claims the benefit of priority to Australian Provisional Patent Application No. 2015903197, filed Aug. 10, 2015, the entire contents and disclosures of which are both hereby incorporated by reference in their entireties.

BACKGROUND

The present invention relates to a method of gaming, a gaming system, a gaming server and a game controller.

In existing gaming systems, the manner in which game outcomes are evaluated is dependent upon the wager placed by a player of the gaming system.

A need exists for alternative gaming systems.

SUMMARY

Systems and methods of electronic gaming are disclosed. In various embodiments, a gaming system may include an electronic gaming machine, which may comprise a display configured to display a wagering game, a player input interface, and a credit input mechanism configured to establish a credit balance. The gaming machine may further comprise a memory and a game controller communicatively coupled to the memory. In various embodiments, the method may comprise receiving a credit wager to initiate play of a game, selecting a plurality symbols from a plurality of reel strips stored in the memory, displaying the selected plurality of symbols in a plurality of adjacent columns of symbol display positions, dividing the symbol display positions in each of the plurality of columns into a first subset of symbol display positions and a second subset of symbol display positions, determining whether an evaluation change condition has been met with respect to a column in the plurality of columns, a first game evaluation based upon the evaluation change condition, and performing a second game evaluation based upon the evaluation change condition.

BRIEF DESCRIPTION OF THE DRAWINGS

An exemplary embodiment of the invention will now be described with reference to the accompanying drawings in which.

DETAILED DESCRIPTION

Figure 1:
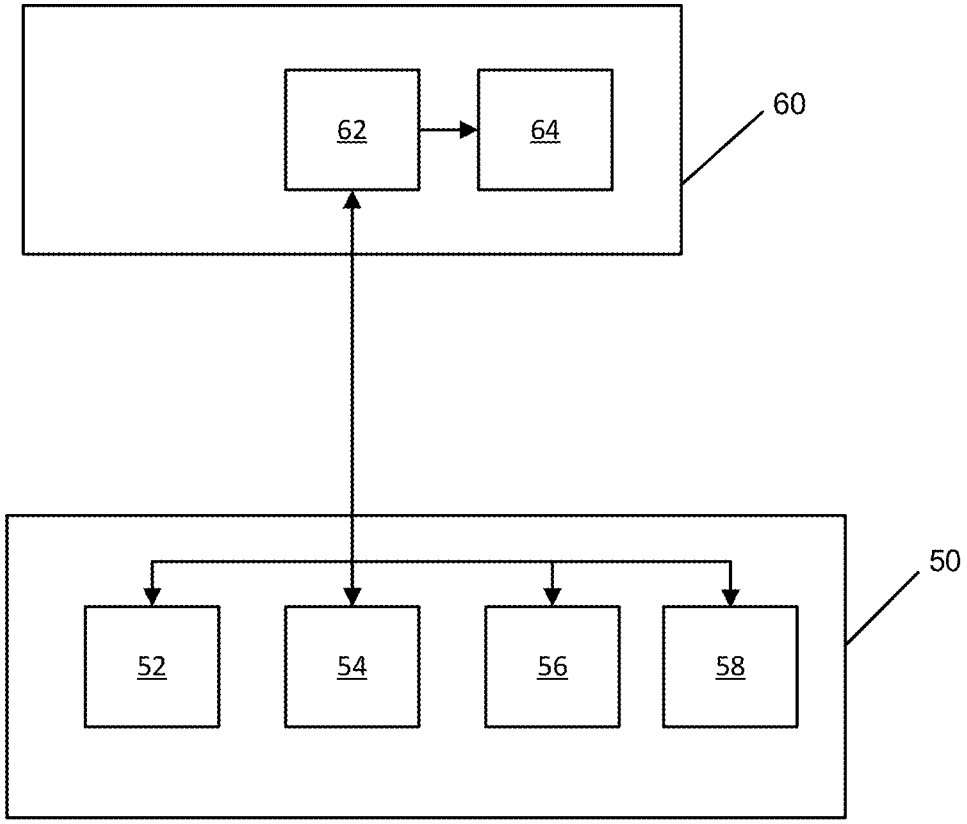
FIG. 1 is a block diagram of exemplary core components of a gaming system.

Referring to the drawings, there is shown a gaming system that includes a game controller. The game controller comprises components that enable the evaluation of game outcomes by the game controller and that enable the game controller to be controlled such that the game controller carries out the evaluation in different ways depending on whether an evaluation change condition is met.

General Construction of an Exemplary Gaming System

The gaming system may assume a number of different forms and/or aspects. In a first aspect, a standalone gaming machine is provided in which all or most components required for implementing the game are present in a player operable gaming machine.

In a second aspect, a distributed architecture is provided wherein at least some of the components required for implementing the game are present in a player operable gaming machine and at least some of the components required for implementing the game are located remotely from the gaming machine. For example, a "thick client" architecture may be used wherein part of the game is executed on a player operable gaming machine and part of the game is executed remotely from the gaming machine, such as by a gaming server. Alternatively, a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may selectively operate in standalone gaming machine mode, "thick client," mode or "thin client" mode depending on several factors, including, for example, the game being played, operating conditions, and/or other factors. Other variations will be apparent to persons skilled in the art.

FIG. 1 is a block diagram of exemplary core components of a gaming system. The gaming system may include several core components, such as core components 50 and 60, comprising a player interface 50 and a game controller 60, respectively. Player interface 50 is arranged to enable manual interaction between a player and the gaming system and for this purpose includes various input/output components required for the player to enter instructions to play the game and observe the game outcomes.

Components of player interface 50 may vary from embodiment to embodiment but will typically include at least a credit mechanism 52 to enable a player to input credits and receive payouts, at least one display 54, a game play mechanism 56 including one or more input devices that enable a player to input game play instructions (e.g. to place a wager), and one or more speakers 58.

Game controller 60 is in data communication with player interface 50 and typically includes a processor 62 that processes the game play instructions in accordance with game play rules and outputs game play outcomes to display 54. Typically, the game play rules are stored as program code in a memory 64 but can also be hardwired. As used herein, the term "processor" refers generically to any device that can process game play instructions in accordance with game play rules and may include, for example, a microprocessor, microcontroller, programmable logic device or other computational device, a general purpose computer (e.g. a PC) or a server. That is, a processor 62 may be provided by any suitable logic circuitry for receiving inputs, processing them in accordance with instructions stored in memory 64 and generating outputs (for example on display 54). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
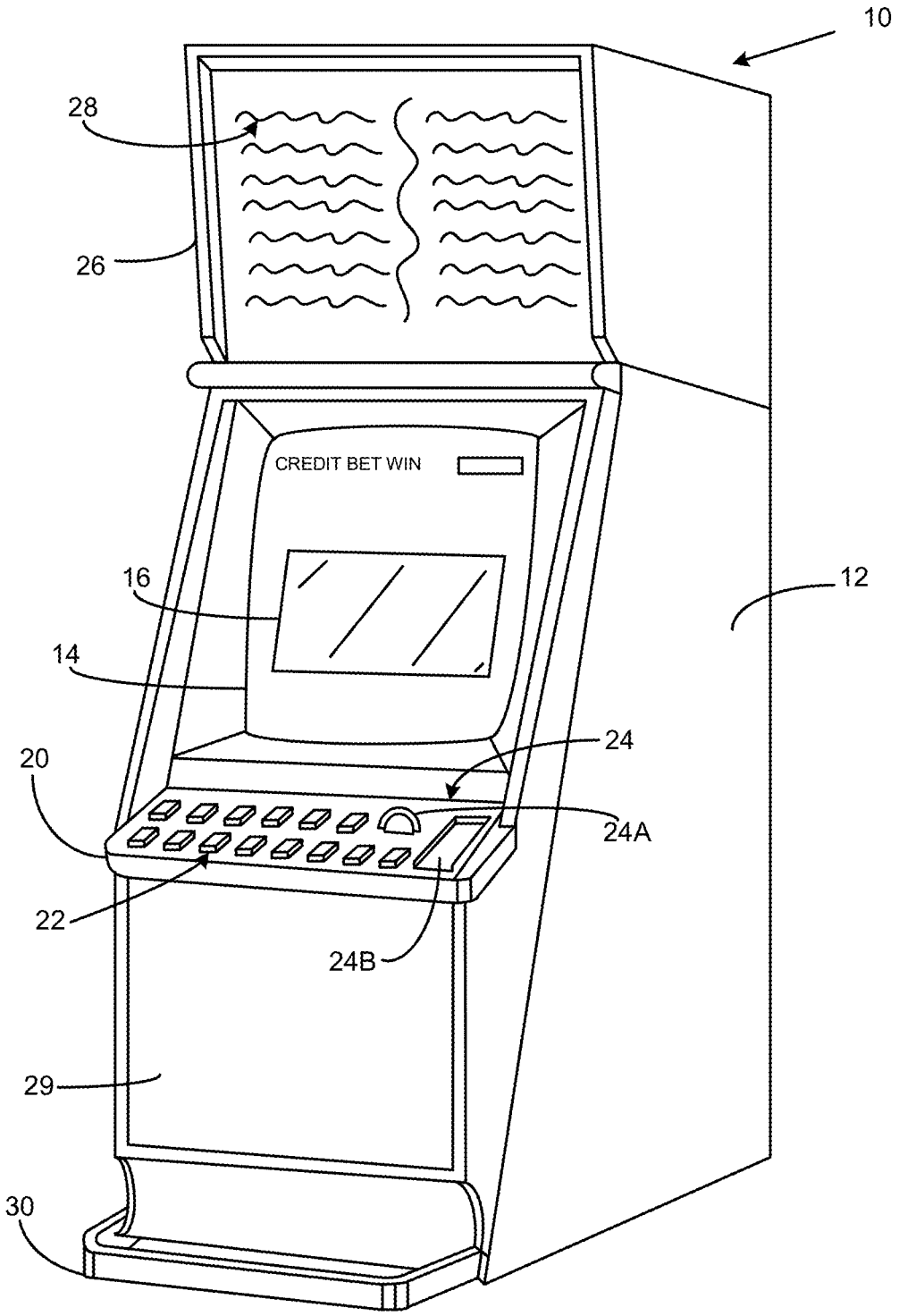
FIG. 2 is a perspective view of an exemplary standalone gaming machine.

FIG. 2 illustrates a gaming system in the form of an exemplary standalone gaming machine 10. In the exemplary embodiments, gaming machine 10 includes a console 12 having a display 14 on which are displayed representations of a game 16 that can be played by a player. A mid-trim 20 of gaming machine 10 houses a bank of buttons 22 for enabling a player to interact with gaming machine 10, in particular during game play. Mid-trim 20 may also house a credit input mechanism 24, which may include a coin input chute 24A and/or a bill collector 24B. Other credit input mechanisms may also be employed, such as, for example, a card reader for reading a smart card, a credit or debit card, and the like. Gaming machine 10 may further, in various embodiments, include a ticket reader (such as a ticket-in-ticket-out or TITO device) for reading tickets having a value and crediting the player based on the face value of the ticker. Gaming machine 10 may also include a player marketing module configured to scan or read a player tracking device, such as, for example, a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

A top box 26 may include artwork 28, such as, for example, artwork depicting one or more pay tables, bonus award information, as well as other game information or imagery. Further artwork and/or information may be provided on a front panel 29 of console 12. A coin tray 30 may be mounted beneath front panel 29 for dispensing cash payouts from gaming machine 10.

Display 14 may comprise any suitable display, such as a liquid crystal display, a cathode ray tube display, a plasma display, an OLED display, and the like. Top box 26 may also include a display, which may be of the same or different from display 14.

Figure 3:
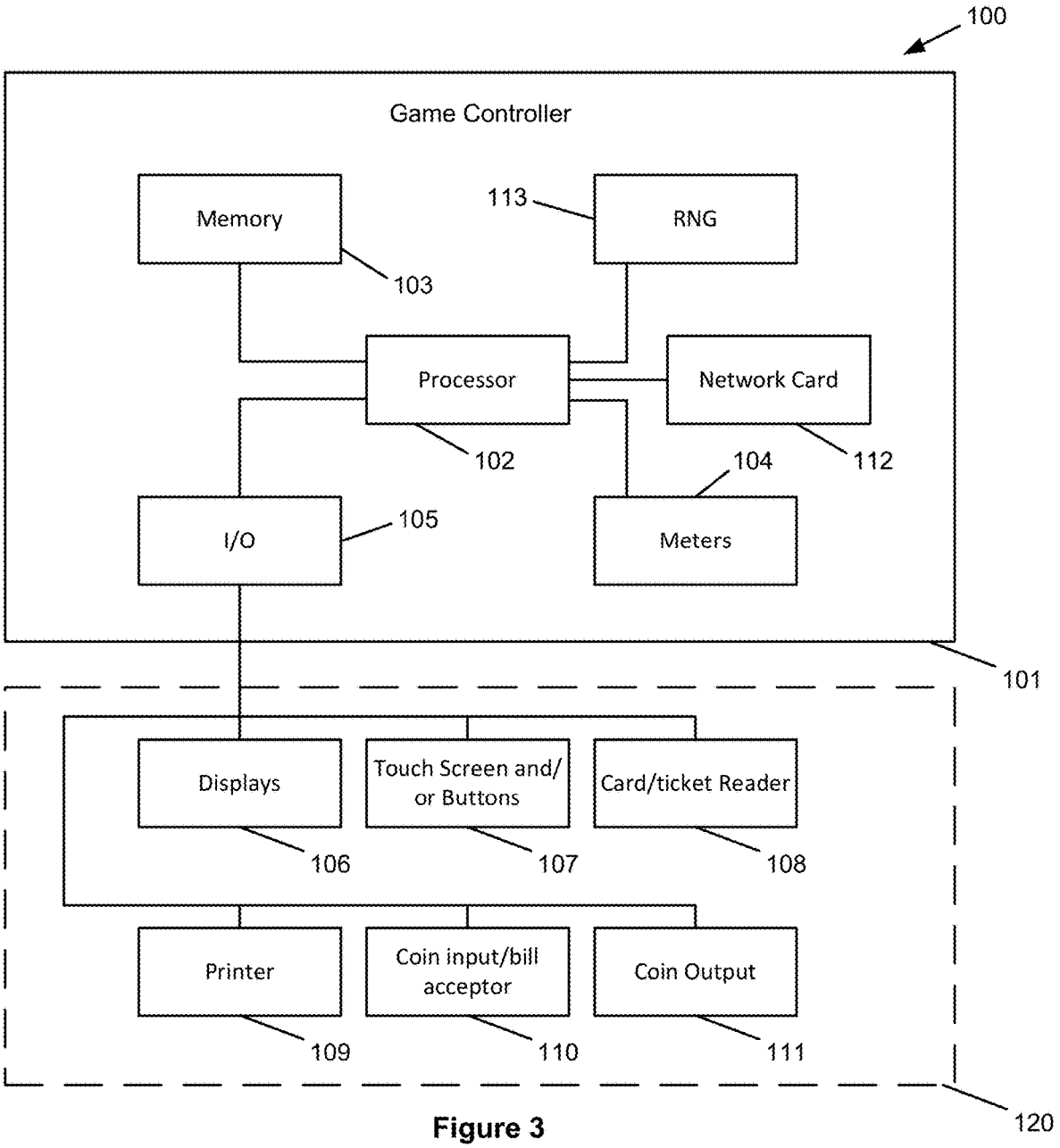
FIG. 3 is a block diagram of exemplary functional components of a gaming machine.

FIG. 3 illustrates a block diagram of exemplary functional components of a typical gaming machine 100, which may be the same as or different from the gaming machine 10 (as shown in FIG. 2).

Gaming machine 100 includes a game controller 101 including a processor 102 mounted on a circuit board. Instructions and data to control operation of processor 102 are stored in a memory 103 that is in data communication with processor 102. Typically, gaming machine 100 will include both volatile and non-volatile memory and more than one of each type of memory, with such memories being collectively represented by memory 103.

Gaming machine 100 may further include hardware meters 104 (to ensure regulatory compliance and to monitor player credit) and/or an input/output (I/O) interface 105 (for communicating with peripheral devices of gaming machine 100). Input/output interface 105 and/or the peripheral devices may comprise intelligent devices with their own memory for storing associated instructions and data. A random number generator module 113 may generate random numbers for use by processor 102. Persons skilled in the art will appreciate that random number generator module 113 may comprise a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, and a coin output mechanism 111. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game). Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information, and/or other information to a bonus controller, central controller, server or database and receive data or commands from the bonus controller, central controller, and/or server or database. In various embodiments (e.g., embodiments that employ a player marketing module), communications over a network may be via the player marketing module—e.g., the player marketing module may be in data communication with one or more of the above devices.

Figure 4:
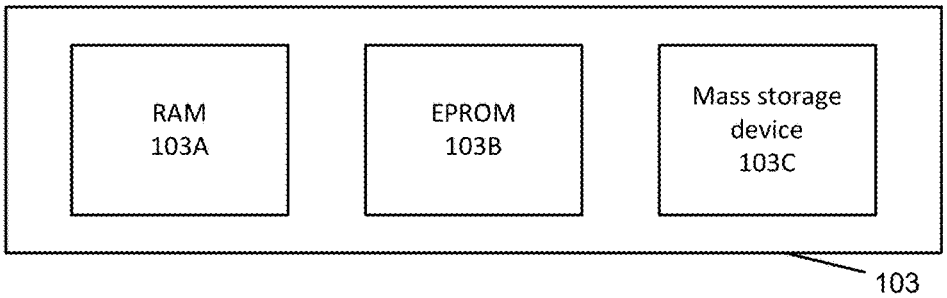
FIG. 4 is a schematic diagram of exemplary functional components of a memory.

FIG. 4 is a block diagram of the main components of a memory 103. In the exemplary embodiment, memory 103 includes RAM 103A, EPROM 103B and a mass storage device 103C. RAM 103A typically temporarily holds program files for execution by processor 102 and related data. EPROM 103B may be a boot ROM device and/or may contain some system or game related code. Mass storage device 103C is typically used to store game programs, the integrity of which may be verified and/or authenticated by the processor 102 using protected code from EPROM 103B or elsewhere.

It is also possible for the operative components of gaming machine 100 to be distributed. For example, in one embodiment, input/output devices 106, 107, 108, 109, 110, and 111 may be provided remotely from game controller 101.

Figure 5:
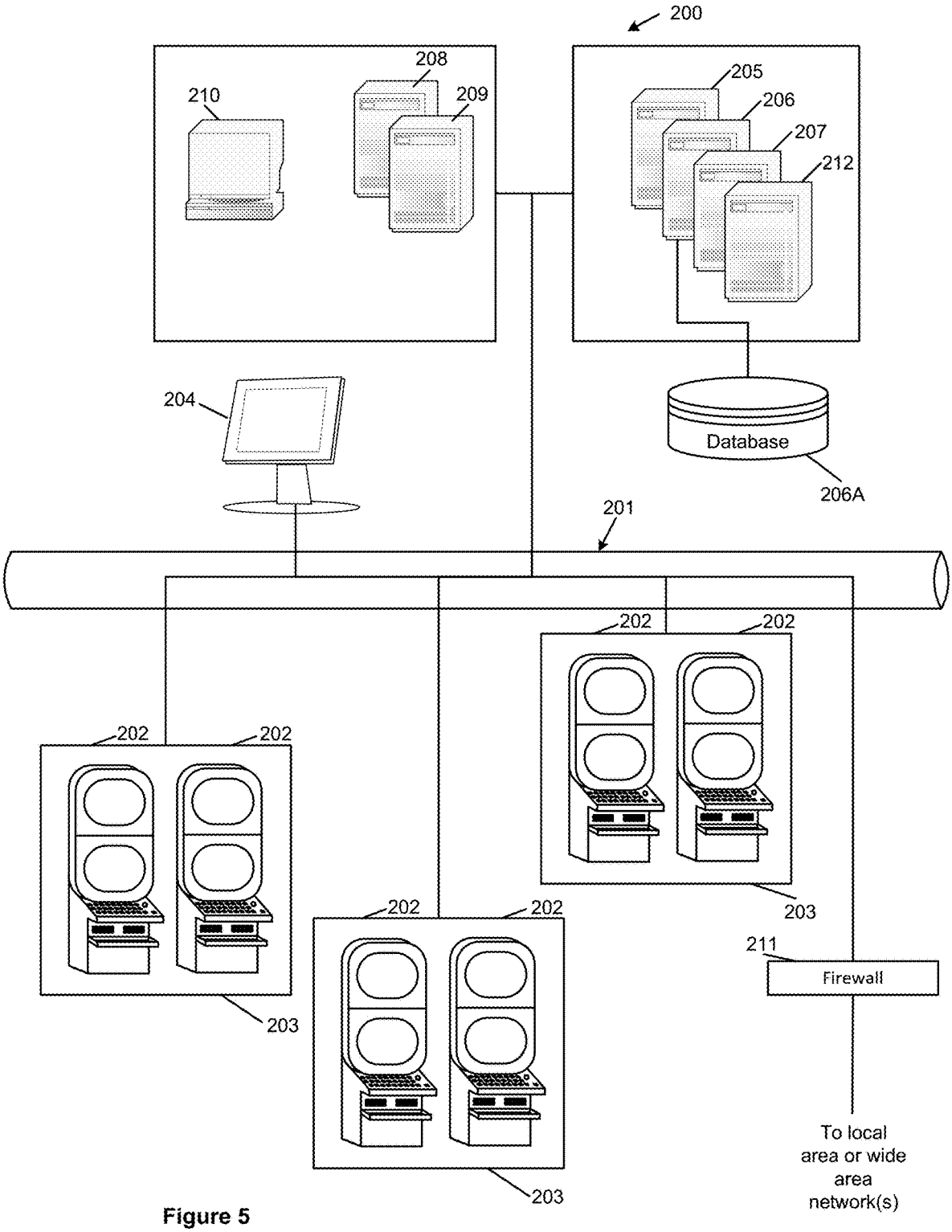
FIG. 5 is a schematic diagram of an exemplary network gaming system.

FIG. 5 illustrates an exemplary gaming system 200 in accordance with an alternative embodiment. Gaming system 200 includes a network 201, which, for example, may comprise a wired or wireless network, such as a Wi-Fi or BLUETOOTH network, an Ethernet network, and RS-232 network, an/or any combination thereof. In the exemplary embodiment, gaming machines 202, shown arranged in three banks 203 of two gaming machines 202, are connected to the network 201. Gaming machines 202 may provide a player operable interface and may be the same as (or substantially similar to) the gaming machines 10 and 100 (as shown in FIGS. 2 and 3), or may have simplified functionality depending, for example, on various game play requirements. Any suitable number of gaming machine banks 203 may be utilized.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example, promotional or informational material.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively comprise a game controller. A database management server 206 may manage storage of game programs and associated data for downloading or access by gaming machines 202 in a database 206A. Typically, if gaming system 200 enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and gaming machine 202 essentially provides only the player interface. In such an embodiment, game server 205 provides the game controller. Gaming machine 202 receives player instructions and transmits these instructions to game server 205. In a thin client embodiment, gaming machines 202 may be computer terminals, such as, for example, personal computers running software that provides a player interface. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including, for example, a gaming floor management server 208 and a licensing server 209 to monitor the use of licenses relating to particular games. An administrator terminal 210 is provided to allow an administrator to run network 201 and the devices connected to the network 201.

Gaming system 200 may communicate with other gaming systems and/or other local networks, such as, for example, a corporate network and/or a wide area network such as the Internet. Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 could run a random number generator engine. Alternatively, a separate random number generator server could be provided. Further, persons skilled in the art will appreciate that a plurality of game servers could be provided to run different games or a single game server may run a plurality of different games as required by the terminals.

Further Details of the Exemplary Gaming System

In one embodiment, a player may place a wager using game play mechanism 56. A game (or game session) may be initiated in response to placement of the wager, a plurality of symbols randomly drawn, and a game (or game session) outcome determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In an embodiment, a player may select a number of reels to play. Games of this type are marketed under the trade name "Reel Power" by Aristocrat Leisure Industries Pty Ltd and are also known as "ways" to win games. Such a reel selection option may permit the substitution of one displayed symbol for another. In other words, all symbols displayed at symbol display positions corresponding to a selected reel can be used to form symbol combinations with symbols displayed at designated symbol display positions of the other reels. For example, if there are five reels and three symbol display positions for each reel such that the symbol display positions comprise three rows of five symbol display positions, the symbols displayed in the center row may be used for non-selected reels. As a result, the total number of ways to win may be determined by multiplying the number of active display positions of each reels, the active display positions being all display positions of each selected reel and the designated display position of the non-selected reels. In this example, for five reels and fifteen display positions, there are 243 ways to win.

As described in greater detail below, a player may place a wager that entitles the player to two separate symbol evaluations during a particular game or game session. For instance, in an embodiment, the player may select any number of reels to play and may, in response to selection of an option to play all available reels, receive an opportunity for reel symbol reevaluation. Reels may be similarly reevaluated where the only available option is to play all reels. Moreover, in yet another embodiment, the player may be permitted select a number of symbols for reevaluation, and/or the number of symbols displayed may be dependent on such a selection.

In the exemplary embodiment, and as described below, the display positions of the symbol display are arranged in a rectangular matrix comprising a plurality of columns and a plurality of rows. The number of symbols displayed may vary by row and/or column, and some rows and/or columns may include a greater or lesser number of symbols than other rows and/or columns.

Figure 6:
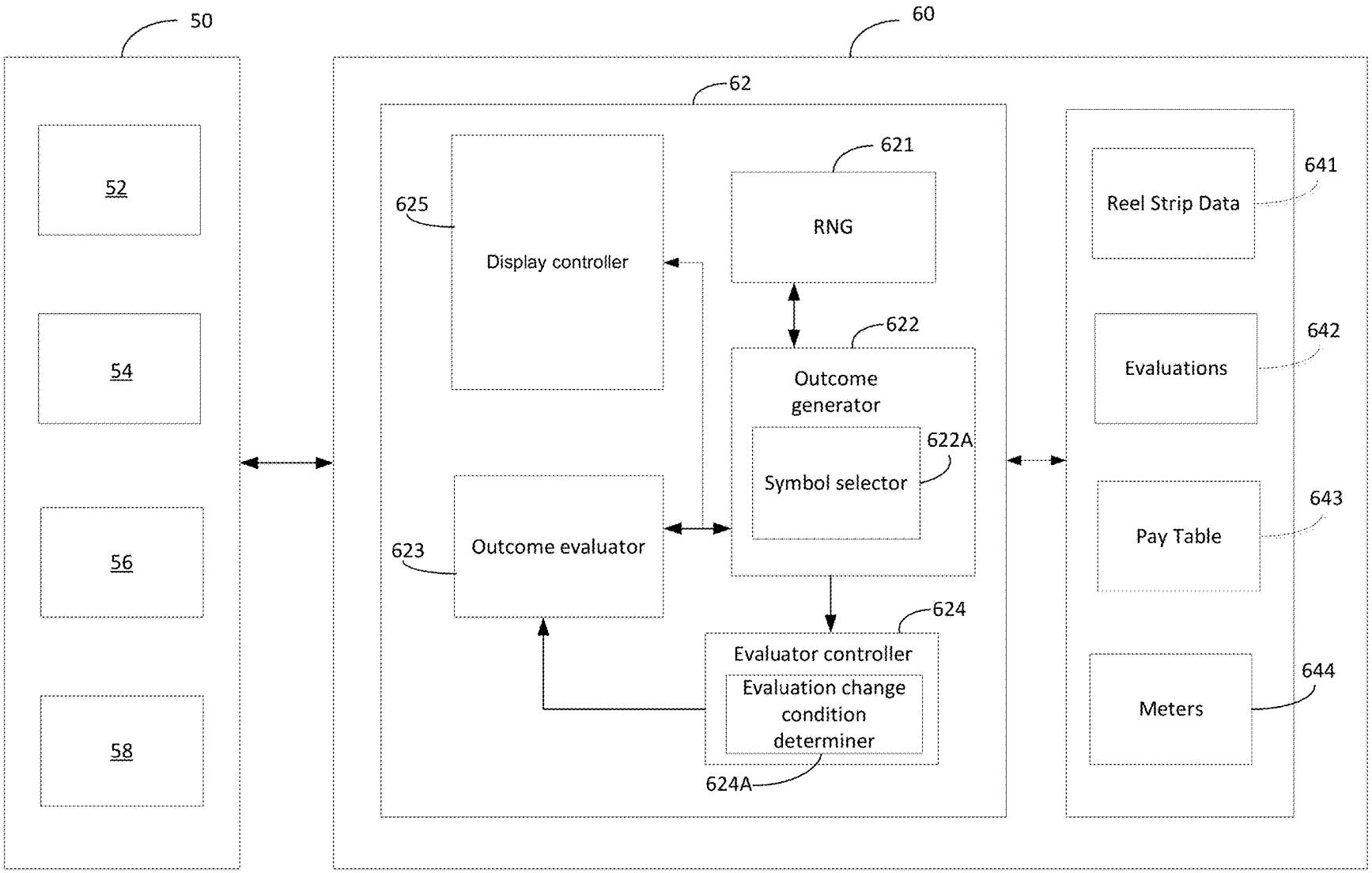
FIG. 6 is a further block diagram of an exemplary gaming system.

FIG. 6 illustrates a block diagram of an exemplary gaming system that includes a plurality of software modules. Processor 62 of game controller 60 is shown implementing a number of such modules based on program code and data stored in memory 64. Persons skilled in the art will appreciate that various of the modules could be implemented in some other way, such as, for example by a dedicated circuit.

In an exemplary embodiment, the various software modules may include outcome generator 622 which may operate in response to the player's operation of game play mechanism 56 to place a wager, and, thereby initiate game play. Thus, as described below, a game outcome may be generated and evaluated (e.g., by outcome generator 622 and/or outcome evaluator 623). In the example embodiment described herein, each wager may entitle a player to two evaluations of a particular group of selected symbols. Such an evaluation (or reevaluation) may be regarded, in various embodiments, as concurrent or serial generation and/or evaluation of first and second games. In various embodiments, greater than two games (or greater than two evaluations of a particular symbol or group of symbols) may be played concurrently or serially by a player. In other words, a symbol or group of symbols may be evaluated and reevaluated any suitable number of times, and evaluations may occur concurrently (e.g., at the same time) or consecutively (e.g., one after another) in any suitable manner.

Accordingly, in an exemplary embodiment, game outcome symbol selector 622A may select any number of symbols from a set of symbols specified by symbol data 641 using an output generated by random number generator 621. The selected symbols may be provided or communicated to the display controller 624, which may display the received symbols on display 54 at a set of symbol display positions.

Figure 8A:
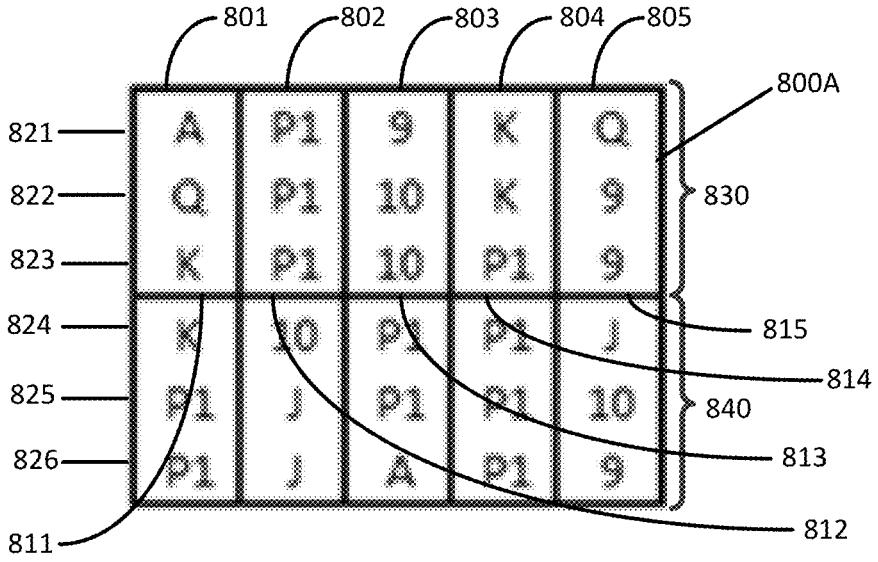
FIG. 8A is an illustration of a game in accordance with various embodiments.
Figure 8B:
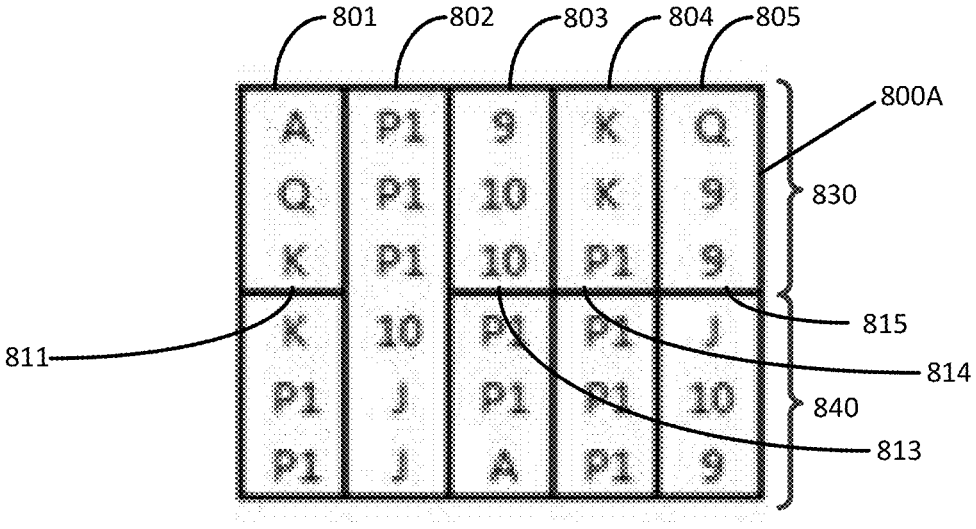
FIG. 8B is an illustration of a game in accordance with various embodiments.

With reference to FIGS. 8A and 8B, a symbol display (including a plurality of symbol display positions) is shown. The symbol display may divided into any suitable number of symbol display positions. For example, as shown, there may be thirty symbol display positions. The symbol display positions may be divided or grouped into any suitable number of symbol subsets, such as, for example, into a first subset 830 of symbols and second subset 840 of symbols.

The symbol display may be further divided into any suitable number of rows and columns. For example, the symbol display may include five columns, such as columns 801, 802, 803, 804, and 805. Each of these columns 801, 802, 803, 804, and 805 may correspond to one of a plurality of reels (or reel strips) 641 stored in memory 64. Reel strips 641 may specify a sequence of symbols for each reel. The symbol display may further include one or more rows, such as rows 821, 822, 823, 824, 825, and 826. In various embodiments, differing numbers of rows may correspond to subsets of symbols. For instance, rows 821, 822, and 823 may correspond to a first subset of symbols, and rows 824, 825, and 826 may correspond to a second subset of symbols. Rows may further be grouped into sub-rows or parts, such as a first part corresponding to rows 821, 822, and 823 and a second part corresponding to rows 824, 825, and 826).

Symbol selector 622A may, in the exemplary embodiment, select a stopping position in the sequence of the respective reel strip using a value obtained from random number generator (RNG) 621. A probability table stored in memory 64 may be referenced to vary the odds of a particular stop position.

Selected symbols may be evaluated by outcome evaluator 623. Evaluator controller 624 may control various evaluation parameters. For example, evaluation controller 64 may include an evaluation change condition determiner 624A, which may determine an evaluation mode. Depending upon the selected evaluation mode, a particular symbol evaluation may be changed from a first mode in which two symbol subsets (e.g., subsets 830 and 840) are evaluated independently to one of a possible number of alternative or secondary evaluation modes. In a secondary mode of evaluation, at least part of a second subset of symbols (e.g., subset 840) may be evaluated in conjunction with the first subset of symbols (e.g., subset 830) and/or part of the second subset of symbols may evaluated in conjunction with part of the first subset of symbols.

In one exemplary embodiment, evaluation change condition determiner 624A may conduct a random trial using RNG 621 to determine, independently, and for each column of the symbol display, whether the evaluation change condition is satisfied. If the evaluation change condition is met, the evaluation mode may be altered from the first mode to the second mode. However, if the evaluation change condition is not satisfied, the evaluation mode may not be altered.

In the first mode of evaluation, the first game evaluation may be evaluated by evaluating symbols displayed at the first subset of symbol display positions 830 and a second game evaluation is performed by evaluating the symbols displayed at the second subset 840 of symbol display positions.

In the second mode of evaluation, evaluation controller 624 may control outcome evaluator 623 to perform the first game evaluation by evaluating symbols displayed at the first subset 830 of symbol display positions in conjunction with the symbols displayed in the second part of the column in respect of which the evaluation change condition is met. That is, the evaluation incorporates the part of the column that normally belongs to second subset 840 of symbol display positions. At the same time, outcome evaluator 623 conducts the second game evaluation by evaluating symbols displayed in second subset 840 of symbol display positions in conjunction with the symbols displayed in the first part of the column in respect of which the evaluation change condition is met.

Thus, as described above, the evaluation change condition may be met or satisfied with respect to one or more columns. Where an evaluation change condition is met with respect to a plurality of columns, the second mode of evaluation may involve conducting the first game evaluation by evaluating symbols displayed at first subset 830 of symbol display positions in conjunction with the symbols displayed in the respective second part (corresponding to rows 824, 825, and 826) of each column with respect to which the evaluation change condition is met. Similarly, the second game evaluation may be performed by evaluating symbols displayed at second subset 840 of symbol display positions in conjunction with the symbols displayed in the respective first part (corresponding to rows 821, 822, and 823) of each column with respect to which the evaluation change condition is met. The selection of relevant evaluations 642, is as described above, controlled by the evaluation controller 624. In the exemplary embodiment, each of the evaluations may involve determining whether there are any winning outcomes defined in paytable 643.

After the evaluations are complete, at least one meter, typically the win meter of meters 644, may be updated to reflect the evaluations.

Figure 7:
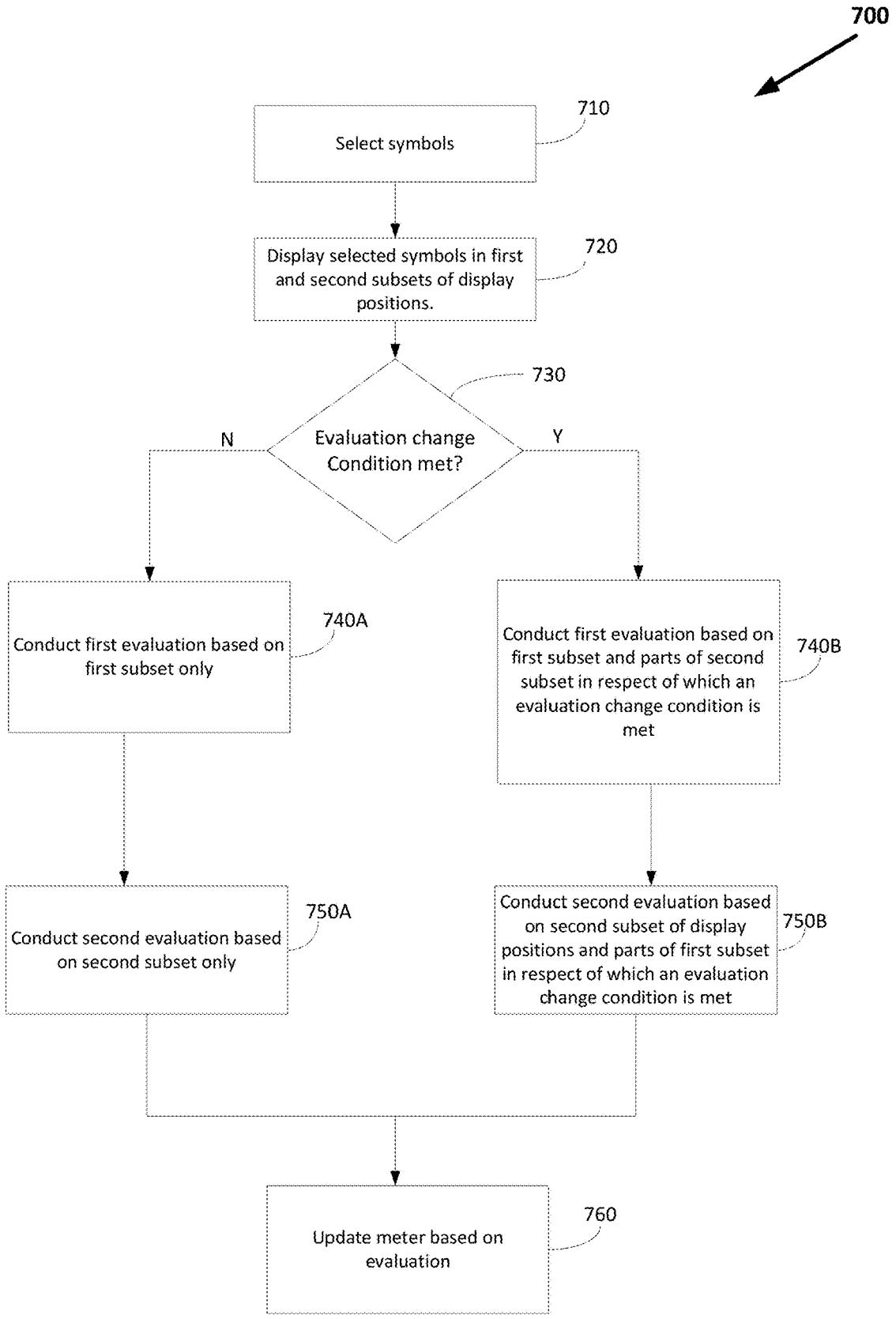
FIG. 7 is a flowchart of an exemplary method of electronic gaming.

With reference to FIG. 7, a method 700 for electronic gaming is shown. As described elsewhere herein, the method 700 may comprise, at steps 710 and 720, selecting symbols and displaying the selected symbols in first and second subsets of symbol display positions. At step 730, the method may determine whether an evaluation change condition is met. If the evaluation change condition is not met, at steps 740A and 750A, evaluation may proceed in a first mode in which a first evaluation is based upon the first subset of symbol display positions and a second evaluation is based upon the second subset of symbol display positions. If an evaluation change condition is met, the method may proceed, at steps 740B and 750B, in a second mode in which a first evaluation is based on a first subset and those parts of the second subset with respect of which the evaluation change condition has been met, and a second evaluation is based upon the second subset and those parts of the first subset with respect to which an evaluation change condition has been met. The method may terminate at step 760, during which a meter may be updated based upon the various evaluations.

The symbol evaluation change condition may coincide with the occurrence of a trigger event, such as, for example, the occurrence of a predefined symbol combination during a game, the occurrence of a specific symbol during a game, a random evaluation, and the like.

Further aspects of the method will be apparent from the above description of the system. It will be appreciated that at least part of the method may be implemented electronically, for example, digitally by a processor executing program code such as in the above description of a game controller. In this respect, insofar as in the above description certain steps are described as being carried out by a processor of a gaming system, it will be appreciated that such steps may often require a number of sub-steps to be carried out for the steps to be implemented electronically, such as, for example, due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device (e.g. an EEPROM that could replace part of memory 103). Further different parts of the program code can be executed by different devices, for example in a client server relationship. Persons skilled in the art will appreciate that program code provides a series of instructions executable by the processor.

Example Embodiment

With returning reference to FIG. 8A, two reel power games with a 5×3 matrix stacked on top of each other are shown. For purposes of illustration, all symbols may be regarded as paying left to right. However, in various embodiments, symbols may pay right to left, vertically, diagonally, and the like.

In the exemplary embodiment, five barriers are displayed to indicate that an evaluation change condition has not been met. In particular, a first barrier 811 is shown between first game or subset 830 and second game or subset 840 in first reel 801. Likewise, a second barrier 812 is shown on second reel 802, a third barrier 813 is shown on third reel 803, a fourth barrier 814 is shown on fourth reel 804, and a fifth barrier 815 is shown on fifth reel 805.

A barrier may thus indicate that an evaluation change condition has not been met. For instance, since no barriers have been broken in FIG. 8A, no evaluation change conditions have been met in the example of FIG. 8A, and both games or subsets 830 and 840 may include 243 ways to win. FIG. 8A also illustrates that in this case neither of the games have any wins.

With reference to FIG. 8B, the barrier 812 is shown as broken. In this instance, then, an evaluation change condition has been met, and all of second reel 802 may be be shared with both games. More particularly, the first part of the second column may be used in the evaluation of the second game, and the second part of the second column may be used in the evaluation of the first game. As a result, both games 830 and 840 may include 486 ways to win.

In other words, all the symbols in second reel 802 (i.e. P1, P1, P1, 10, J and J) may be used for both first game or subset 830 and second game or subset 840. In this example, the first game may still pay nothing, but the second game may now generate an award, such as an award calculated according to the following formula: pay=4 PIC1×36.

In other exemplary embodiments, more than one barrier may be broken at a time, barriers may only be placed in certain of the reels, and/or a player may only be permitted to satisfy the evaluation change condition with respect of certain reels (and hence break the barriers with respect to certain reels). For example, a first wager amount may entitle or permit a player to break a first number of barriers and a second wager amount may entitle or permit the player to break a second number of barriers.

It will be understood to persons skilled in the art of the disclosure that many modifications may be made without departing from the spirit and scope of the disclosure. In particular it will be apparent that certain features of embodiments of the disclosure can be employed to form further embodiments.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments.

What is claimed is:

1. An electronic gaming system comprising:

a display configured to display a wagering game;

a player input interface configured to receive a player input;

a credit input mechanism configured to receive a credit wager, the credit wager initiating play of a base game;

a tangible, non-transitory, computer-readable memory; and a game controller communicatively coupled to the memory, the game controller configured to:

select and display symbols on a matrix of display positions, the matrix being configured into a plurality of columns, wherein at least one column of the plurality of columns is initially divided into a first subset of symbol display positions for a first reel game and a second subset of symbol display positions for a second reel game, and wherein the first subset of symbol display positions is initially separated from the second subset of symbol display positions by a displayed barrier;

determine whether an evaluation change condition has been met with respect to a column in the plurality of columns;

if the evaluation change condition has been met, eliminate display of the displayed barrier from the column in the plurality of columns while maintaining display of the first subset of symbol display positions and the second subset of symbol display positions; and perform a game evaluation based upon the evaluation change condition, the game evaluation including an evaluation of symbols at the other columns of the plurality of columns with symbols at the first subset of symbol display positions and another separate evaluation of the symbols at the other columns of the plurality of columns with symbols at the second subset of symbol display positions.

2. The system of claim 1, the game controller further configured to perform, in response to a determination that the evaluation change condition is not satisfied, the game evaluation based on the symbols displayed in the first subset of symbol display positions.

3. The system of claim 1, the game controller further configured to perform, in response to a determination that the evaluation change condition is satisfied, the game evaluation based on the symbols displayed in the first subset of symbol display positions and symbols displayed in the second subset of symbol display positions with respect to which the evaluation change condition is satisfied.

4. The system of claim 1, the game controller further configured to update a meter stored in the memory based on the game evaluation.

5. The system of claim 1, wherein the first subset comprises a number of symbol display positions that is equal to a number of symbol display positions comprising the second subset.

6. The system of claim 1, wherein each part of each column has a same number of symbol display positions.

7. The system of claim 1, the game controller further configured to display the barrier, wherein the barrier comprises a separate barrier for each column in the plurality of columns.

8. An electronic method of gaming implemented using a gaming system, the gaming system including a display configured to display a wagering game, a player input interface, a credit input mechanism configured to establish a credit balance that is increasable and decreasable based on wagering activity, a tangible, non-transitory, computer-readable memory, and a game controller communicatively coupled to the memory, the method comprising:

receiving, by the credit input mechanism, a credit wager to initiate play of a game;

selecting and displaying symbols on a matrix of display positions, the matrix being configured into a plurality of columns, wherein at least one column of the plurality of columns is initially divided into a first subset of symbol display positions for a first reel game and a second subset of symbol display positions for a second reel game, and wherein the first subset of symbol display positions is initially separated from the second subset of symbol display positions by a displayed barrier;

determining, by the game controller, whether an evaluation change condition has been met with respect to a column in the plurality of columns;

if the evaluation change condition has been met, eliminating display of the displayed barrier from the column in the plurality of columns while maintaining display of the first subset of symbol display positions and the second subset of symbol display positions; and performing, by the game controller, a game evaluation based upon the evaluation change condition, the game evaluation including an evaluation of symbols at the other columns of the plurality of columns with symbols at the first subset of symbol display positions and another separate evaluation of the symbols at the other columns of the plurality of columns with symbols at the second subset of symbol display positions.

9. The method of claim 8, further comprising performing, by the game controller and in response to a determination that the evaluation change condition is not satisfied, the game evaluation based on the symbols displayed in the first subset of symbol display positions.

10. The method of claim 8, further comprising performing, by the game controller and in response to a determination that the evaluation change condition is satisfied, the game evaluation based on the symbols displayed in the first subset of symbol display positions and symbols displayed in the second subset of symbol display positions with respect to which the evaluation change condition is satisfied.

11. The method of claim 8, further comprising updating, by the game controller, a meter stored in the memory based on the game evaluation.

12. The method of claim 8, wherein the first subset comprises a number of symbol display positions that is equal to a number of symbol display positions comprising the second subset.

13. The method of claim 8, wherein each part of each column has a same number of symbol display positions.

14. The method of claim 8, further comprising displaying, by the game controller, the barrier, wherein the barrier comprises a separate barrier for each column in the plurality of columns.

15. An article of manufacture including a non-transitory, tangible, computer readable storage medium having instructions stored thereon that, in response to execution by a computer-based system configured for electronic gaming, cause the computer-based system to perform operations comprising:

selecting and displaying symbols on a matrix of display positions, the matrix being configured into a plurality of columns, wherein at least one column of the plurality of columns is initially divided into a first subset of symbol display positions for a first reel game and a second subset of symbol display positions for a second reel game, and wherein the first subset of symbol display positions is initially separated from the second subset of symbol display positions by a displayed barrier;

determining, by the computer-based system, whether an evaluation change condition has been met with respect to a column in the plurality of columns;

if the evaluation change condition has been, eliminating display of the displayed barrier from the column in the plurality of columns while maintaining display of the first subset of symbol display positions and the second subset of symbol display positions; and performing, by the computer-based system, a game evaluation based upon the evaluation change condition, the game evaluation including an evaluation of symbols at the other columns of the plurality of columns with symbols at the first subset of symbol display positions and another separate evaluation of the symbols at the other columns of the plurality of columns with symbols at the second subset of symbol display positions.

16. The article of claim 15, further comprising performing, by the computer-based system and in response to a determination that the evaluation change condition is not satisfied, the game evaluation based on the symbols displayed in the first subset of symbol display positions.

17. The article of claim 15, further comprising performing, by the computer-based system and in response to a determination that the evaluation change condition is satisfied, the game evaluation based on the symbols displayed in the first subset of symbol display positions and symbols displayed in the second subset of symbol display positions with respect to which the evaluation change condition is satisfied.

18. The article of claim 15, further comprising updating, by the computer-based system a meter stored in memory based on the game evaluation.

19. The article of claim 15, wherein the first subset comprises a number of symbol display positions that is equal to a number of symbol display positions comprising the second subset.

20. The article of claim 15, further comprising displaying, by the computer-based system, the barrier, wherein the barrier comprises a separate barrier for each column in the plurality of columns.

* * * * *